US010968020B2

(12) United States Patent
Umenaka

(10) Patent No.: US 10,968,020 B2
(45) Date of Patent: Apr. 6, 2021

(54) SELF-STANDING BAG AND METHOD FOR MANUFACTURING THE SAME

(71) Applicant: HOSOKAWA YOKO CO., LTD., Tokyo (JP)

(72) Inventor: Kazuhiro Umenaka, Fujimino (JP)

(73) Assignee: HOSOKAWA YOKO CO., LTD., Tokyo (JP)

( * ) Notice: Subject to any disclaimer, the term of this patent is extended or adjusted under 35 U.S.C. 154(b) by 0 days.

(21) Appl. No.: 16/343,931

(22) PCT Filed: Oct. 5, 2017

(86) PCT No.: PCT/JP2017/036360
§ 371 (c)(1),
(2) Date: Apr. 23, 2019

(87) PCT Pub. No.: WO2018/092460
PCT Pub. Date: May 24, 2018

(65) Prior Publication Data

US 2019/0270564 A1 Sep. 5, 2019

(30) Foreign Application Priority Data

Nov. 21, 2016 (JP) ..... JP2016-226146

(51) Int. Cl.
*B65D 75/00* (2006.01)
*B65D 75/58* (2006.01)

(52) U.S. Cl.
CPC ..... *B65D 75/008* (2013.01); *B65D 75/5883* (2013.01)

(58) Field of Classification Search
CPC ..... B65D 75/008; B65D 75/5883
(Continued)

(56) References Cited

U.S. PATENT DOCUMENTS 4,756,917 A 7/1988 Kamada et al.
4,904,093 A * 2/1990 Woods ..... B65D 31/02 383/104

(Continued)

FOREIGN PATENT DOCUMENTS

JP 59-004927 2/1984
JP 07-100509 11/1995

(Continued)

OTHER PUBLICATIONS

International Search Report for PCT/JP2017/036360 dated Dec. 12, 2017.

(Continued)

*Primary Examiner* — Peter N Helvey
(74) *Attorney, Agent, or Firm* — Nixon Peabody LLP; Jeffrey L. Costellia

(57) ABSTRACT

A self-standing bag (1) is provided, including: a body portion (10) formed of a body member (10A) in a tubular shape; and a bottom portion (12) formed of a half-folded bottom member (12A), in which each of side ends of the bottom member (12A) is bonded to an inner surface of a rear surface portion (20) of the body portion (10), a lower end of the bottom member (12A) is bonded to a lower end of the body portion (10) on an entire circumference of the body portion (10), on the body portion (10) side of the bottom member (12A), an adhesive film (22) for bonding a side end of the bottom member (12A) to the body portion (10) is laminated to cover the entire bottom member (12A), both side ends of the adhesive film (22) respectively protrude from both the side ends of the bottom member (12A) in a width direction, and bonding of the side end of the bottom member (12A) to the inner surface of the body portion (10) is achieved by the adhesive film (22).

2 Claims, 8 Drawing Sheets

(58) Field of Classification Search
USPC ..... 383/104
See application file for complete search history.

(56) References Cited

U.S. PATENT DOCUMENTS

| | | | | |
|---|---|---|---|---|
| 5,059,036 | A * | 10/1991 | Richison | B65D 33/2533 383/102 |
| 5,464,969 | A * | 11/1995 | Miller | B65D 31/00 219/735 |
| 5,937,617 | A * | 8/1999 | Yeager | B65D 75/008 206/217 |
| 5,957,584 | A * | 9/1999 | Lakey | B65D 75/5883 383/104 |
| 5,971,613 | A * | 10/1999 | Bell | B29C 65/18 383/104 |
| 6,375,037 | B1 * | 4/2002 | Bell | B65D 75/008 206/439 |
| 7,648,023 | B2 * | 1/2010 | Maguire, Jr. | A47L 13/19 206/207 |
| 2007/0211967 | A1 * | 9/2007 | Murray | B65D 75/566 383/38 |
| 2007/0217717 | A1 * | 9/2007 | Murray | B65D 75/008 383/38 |
| 2013/0011085 | A1 | 1/2013 | Umenaka | |
| 2014/0120207 | A1 * | 5/2014 | Steele | A47G 21/12 426/2 |
| 2014/0161373 | A1 * | 6/2014 | Yeager | B65B 9/2056 383/42 |
| 2015/0125097 | A1 * | 5/2015 | Kenmotsu | B65D 75/5883 383/104 |
| 2015/0342403 | A1 * | 12/2015 | Wangler | B65D 31/16 206/205 |
| 2015/0360839 | A1 * | 12/2015 | Murray | B65D 75/008 383/7 |
| 2016/0083161 | A1 * | 3/2016 | Moriz | B65D 75/008 383/204 |
| 2016/0194116 | A1 * | 7/2016 | Yeager | B31B 70/60 383/121 |

FOREIGN PATENT DOCUMENTS

| | | |
|---|---|---|
| JP | 08-217086 | 8/1996 |
| JP | 2004-026251 | 1/2004 |
| JP | A-2010-105741 | 5/2010 |
| JP | 2011-195175 | 10/2011 |
| JP | A-2012-192948 | 10/2012 |

OTHER PUBLICATIONS

European Search Report (Application No. 17871369.9) dated May 20, 2020.

* cited by examiner

SELF-STANDING BAG AND METHOD FOR MANUFACTURING THE SAME

TECHNICAL FIELD

The present invention relates to a self-standing bag and a method for manufacturing the same.

Priority is claimed on Japanese Patent Application No, 2016-226146, filed on Nov. 21, 2016, the content of which is incorporated herein by reference.

BACKGROUND ART

As a soft packaging material made of a plastic film or the like, a hag body having self-standing properties, a so-called self-standing hag, is known. A self-standing bag is know which is formed by, in a state where a folded bottom member with the folding line on the upper side, which is to form a bottom portion, is interposed between the lower ends of two body members, which are to form a body portion, heat-sealing the side ends of the two body members together with the side ends of the bottom member, and further heat-sealing the lower ends over the entire circumference. However, in the self-standing bag, the heat-sealed portion between the side ends of the body members formed at the side edges of the body portion acts as a knife edge, which causes discomfort when the body portion is grasped by hand.

As a self-standing bag that solves the discomfort when the body portion is grasped by hand, a self-standing bag is proposed having a body portion, which is formed in a flat tube shape by folding each of both side end sides of a single body member and bonding the side ends to each other at the rear surface. For example, there is a self-standing bag which includes a body portion formed of a body member in a flat tube shape, and a bottom portion formed of a bottom member, which is half-folded and is attached to the inside of the body portion with the folding line on the upper side, in which both side ends of the bottom member are attached to the inner surface of the body portion by two adhesive films respectively covering the side ends (Patent Document 1).

CITATION LIST

Patent Document

[Patent Document] Japanese Unexamined Patent Application, First Publication No. 2011-195175

SUMMARY OF INVENTION

Technical Problem

However, in the self-standing bag as described in Patent Document 1, when the arrangement of the adhesive film deviates in the manufacturing, bonding failure occurs, and leakage of the contents occurs. Therefore, high accuracy is required for the arrangement position of the adhesive film, and particularly in a case of a self-standing bag with a small size, it is difficult to manufacture the self-standing bag.

In addition, in the self-standing bag, since a load applied to the bottom portion is large in a self-standing state, it is important for the bottom portion to have excellent pinhole resistance.

An object of the present invention is to provide a self-standing bag which gives no discomfort when a body portion is grasped by hand, can be easily manufactured even if the size is small, can stably suppress leakage of contents, and has excellent pinhole resistance at a bottom portion, and a method for manufacturing the same.

Solution to Problem

[1] A self-standing bag, including: a body portion formed of a body member in a tubular shape; and a bottom portion formed of a half-folded bottom member which is attached to an inside of the body portion with a folding line of the bottom member on an upper side, in which each of side ends of the bottom member is bonded to an inner surface of the body portion, a lower end of the bottom member is bonded on a lower end side of the body portion on an entire circumference of the body portion, on the body portion side of the bottom member, an adhesive film for bonding a side end of the bottom member to the body portion is laminated to cover the entire bottom member, both side ends of the adhesive film respectively protrude from both the side ends of the bottom member in a width direction, and bonding of the side end of the bottom member to the inner surface of the body portion is achieved by the adhesive film.

[2] The self-standing bag according to [1], in which the body portion has a flat shape having a front surface portion and a rear surface portion, and in a state where the side end sides of the bottom member are folded at side edges of the body portion, each of the side ends of the bottom member is bonded to an inner surface of the front surface portion or the rear surface portion.

[3] A method for manufacturing a self-standing bag, including:

a step (I) of forming a laminate by laminating a film-like bottom member and an adhesive film to cause both side edges of the adhesive film in a width direction to protrude from both side edges of the bottom member in the width direction;

a step (II) of half-folding the laminate at a folding line of the bottom member extending in the width direction so as to cause the adhesive film to be on an outside;

a step (III) of placing the half-folded laminate on a film-like body member;

a step (IV) of attaching a side end of the bottom member to the body member by the adhesive film;

a step (V) of forming a body portion by bonding side ends of the body member to each other into a tubular shape so as to cause a surface of the body member bonded to the bottom member to be an inner surface; and a step (VI) of forming a bottom portion by bonding a lower end of the bottom member and a lower end side of the body portion on an entire circumference of the body portion.

[4] The method for manufacturing a self-standing bag according to [3], in which, in the step (V), the side end sides of the body member are folded together with side end sides of the bottom member such that a surface of the body member bonded to the bottom member is the inner surface and folding lines are positioned closer to a center than both the side ends of the bottom member.

[5] The method for manufacturing a self-standing bag according to [3] or [4], in which, in the step (I), the laminate is formed by bonding the bottom member and the adhesive film to each other along both the side ends of the bottom member.

Effects of Invention

The self-standing bag of the present invention gives no discomfort when the body portion is grasped by hand, can be easily manufactured even if the size is small, can stably suppress leakage of contents, and has excellent pinhole resistance at the bottom portion.

With the method for manufacturing a self-standing bag of the present invention, the self-standing bag can be easily manufactured even if the size is small, can stably suppress leakage of contents, and has excellent pinhole resistance at the bottom portion is obtained.

DESCRIPTION OF EMBODIMENTS

[Self-Standing Bag]

Hereinafter, as an example of a self-standing bag of the present invention, a self-standing bag provided with a spout for pouring stored contents will be described in detail with reference to FIGS. 1 to 5B.

Figure 1:
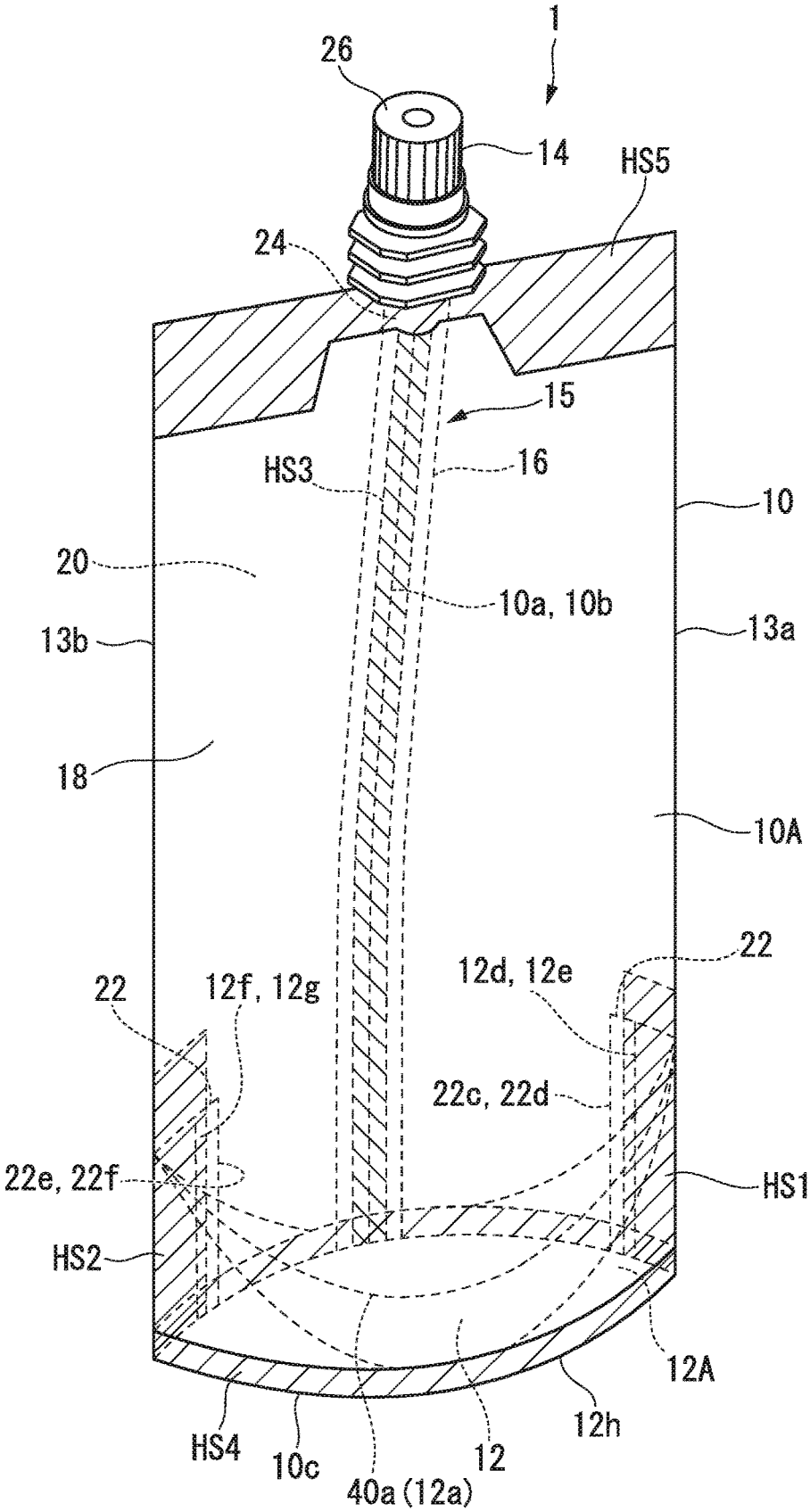
FIG. 1 is a perspective view illustrating an example of a self-standing bag of the present Invention.
Figure 2:
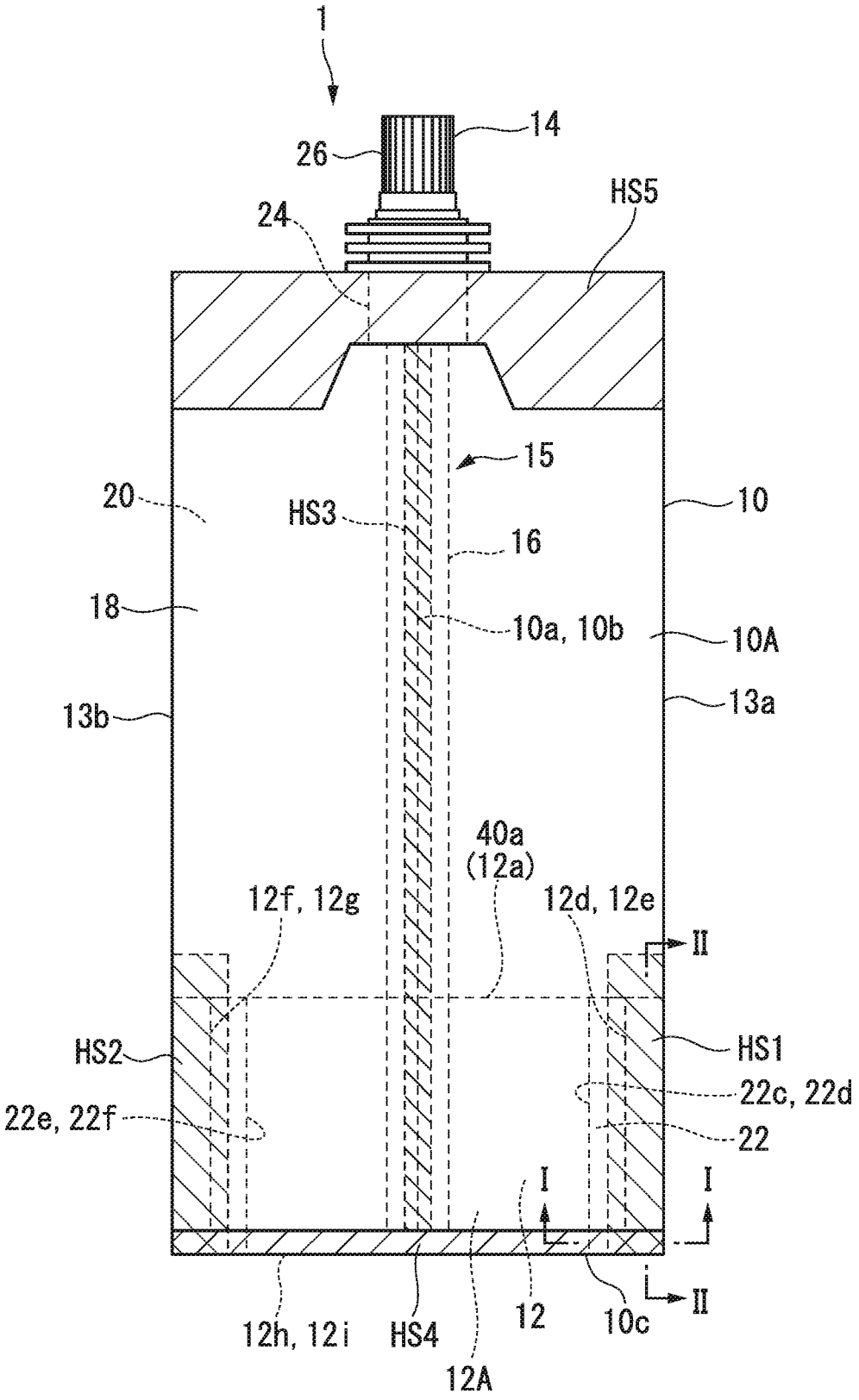
FIG. 2 is a front view illustrating a flat state of the example of the self-standing bag of the present invention.

A self-standing bag 1 of an embodiment is a bag having self-standing properties, and as illustrated in FIGS. 1 and 2, includes a body portion 10, a bottom portion 12 provided in the body portion 10, and a spout 14 which is provided in the upper end portion of the body portion 10 for pouring stored contents. Specifically, the self-standing bag 1 includes the body portion 10 formed of a body member 10A in a tubular shape, and the bottom portion 12 formed of a half-folded bottom member 12A which is attached to the inside of the body portion 10 with a folding line 12*a* of the bottom member 12A on the upper side, side ends 12*d* and 12*e* and side ends 12*f* and 12*g* of the bottom member 12A are bonded to the inner surface of the body portion ID, and lower ends 12*h* and 12*i* of the bottom member 12A are bonded to the entire circumference of the body portion 10 on the lower end side of the body portion 10. On the body portion 10 side of the bottom member 12A, an adhesive film 22 for bonding the side ends 12*d* and 12*e* and the side ends 12*f* and 12*g* of the bottom member 12A to the body portion 10 is laminated to cover the entire bottom member 12A. Both side ends 22*c* and 22*d* and side ends 22*e* and 22*f* of the adhesive film 22 respectively protrude from both the side ends 12*d* and 12*e* and the side ends 12*f* and 12*g* of the bottom member 12A in a width direction thereof, and bonding of the side ends 12*d* and 12*e* and the side ends 12*f* and 12*g* of the bottom member 12A to the inner surface of the body portion 10 is achieved by the adhesive film 22. The self-standing bag 1 can contain contents therein and can pour the stored contents from the spout 14. When the contents are stored in the self-standing bag 1, the self-standing bag 1 has a circular or substantially elliptical shape and may also have a blunt corner portion as viewed from below.

The body portion 10 has a tubular shape and is formed of the body member 10A having a rectangular film shape. Specifically, both side end sides of the body member 10A are folded along folding lines L1 and L2 illustrated in FIG. 3B, and as illustrated in FIGS. 1 and 2, a side end 10*a* and a side end 10*b* are caused to abut each other to form a tubular shape. The body portion 10 has a flat shape in a state where the contents are not stored, and has a front surface portion 18 and a rear surface portion 20.

In the body portion 10, a part 11A between the folding line L1 and the folding line L2 of the body member 10A forms the front surface portion 18. In addition, a part 11B between the folding line L1 and the side end 10*a* in the body member 10A and a part 11C between the folding line L2 and the side end 10*b* constitute the rear surface portion 20. Furthermore, parts of the body member 10A at the folding line L1 and the folding line L2 respectively form side edges 13*a* and 13*b* of the body portion 10.

As the body member 10A, a laminated film in which at least a base material layer and a sealant layer are laminated and the sealant layer is the innermost layer is preferable.

As the base material layer, a film having excellent printability and further having piercing strength, tensile strength, impact resistance, and the like is preferable. Examples of the material of the base material layer include polyethylene terephthalate, polypropylene, polyamide, and ethylene vinyl alcohol copolymer, and biaxially stretched films or uniaxially stretched films thereof are preferable. In addition, in order to impart barrier properties for oxygen and water vapor to these films, a vapor-deposited film in which a metal such as aluminum or magnesium, or an oxide such as silicon oxide is deposited, a coated film coated with a barrier coating agent such as polyvinylidene chloride, or the like may be used. The base material layer may be a single body of the film or may be a laminate.

The sealant layer is a layer which can be heated and melted in a temperature range in which the shape of the base material layer can be maintained, and can be heat-sealed. Examples of the material of the sealant layer include polyethylene such as high-density polyethylene, low-density polyethylene, and linear low-density polyethylene, and polypropylene, and unstretched films thereof and those obtained by extruding the resins into a layer form are preferable.

The laminated film may have an intermediate layer between the base material layer and the sealant layer as necessary.

Examples of the intermediate layer include films having functions such as oxygen barrier properties, water vapor barrier properties, and tearing properties. Specific examples of the intermediate layer include a metal foil such as aluminum, the above-described vapor-deposition film, and a coating film.

The laminated film including the base material layer, the sealant layer, and the intermediate layer used as necessary can be produced by a known method such as a dry lamination method using an adhesive or an extrusion lamination method using a thermal adhesive resin.

The body member 10A may be a single layer film made of a heat-sealable film.

Figure 4A:
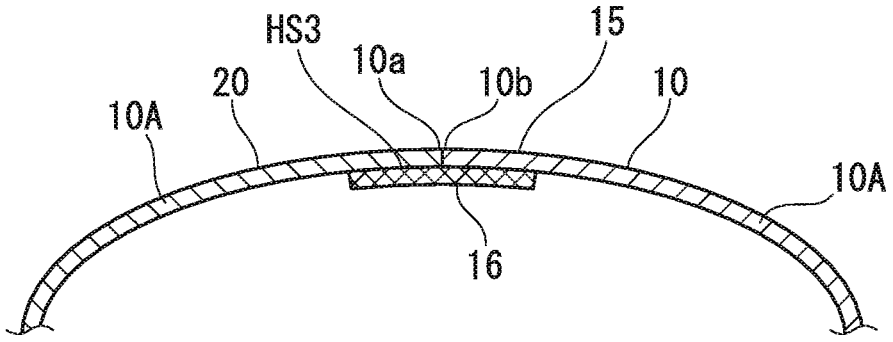
FIG. 4A is a cross-sectional view illustrating an example of an embodiment of a rear joint of the self-standing bag of the present invention.

A form in which the body member 10A has a tubular shape is, in this example, as illustrated in FIGS. 1, 2, and 4A, a form in which the side end 10*a* and the side end 10*b* of the body member 10A are caused to abut each other with no gap therebetween and, in a state where an adhesive film 16 overlaps with the inner surface side thereof, are heat-sealed in a heat-sealed portion HS3 to form a rear joint 15. In this case, the side end 10*a* and the side end 10*b* of the body member 10A may be sealed with no gap by the adhesive film 16 even if there is a slight gap or a slight overlap.

The adhesive film 16 is a film of the same kind as the resin forming the sealant layer of the body member and the bottom member, both sides of which have a heat-sealable property capable of being thermally fused to the sealant layers of the body member and the bottom member. Examples of the adhesive film 16 include a laminated film having sealant layers on both sides, a single layer film, and a coextruded film. Particularly, a single layer synthetic resin film is preferable as the adhesive film 16 from the viewpoint of being entirely melted in the thickness direction by heat of heat sealing and thus further reduced in thickness.

Figure 4B:
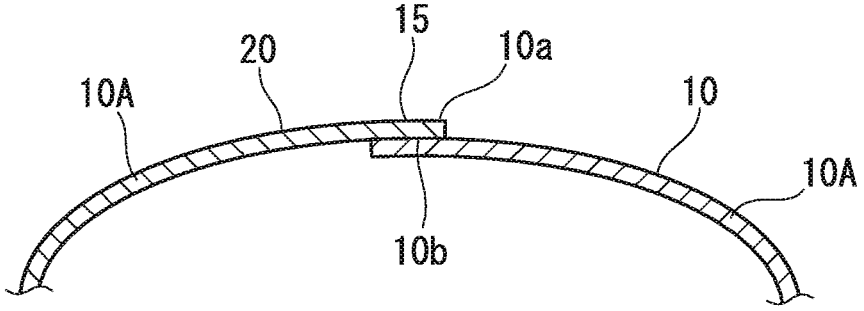
FIG. 4B is a cross-sectional view illustrating an example of the embodiment of the rear joint of the self-standing bag of the present invention.
Figure 4C:
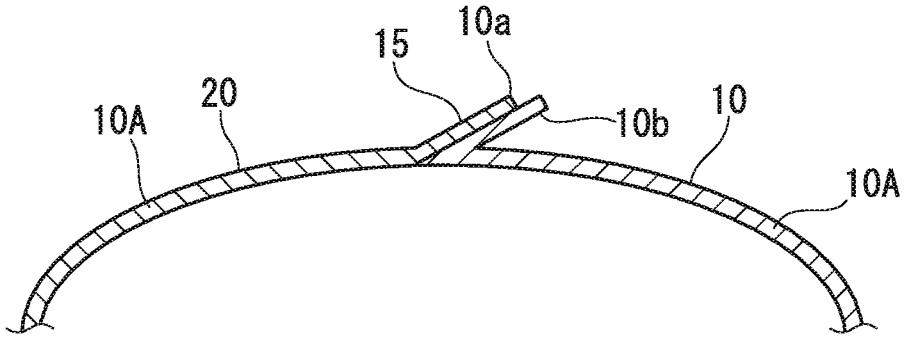
FIG. 4C is a cross-sectional view illustrating an example of the embodiment of the rear joint of the self-standing bag of the present invention.

The form of the rear joint 15 is not limited to the form using the adhesive film 16. For example, the form may be, as illustrated in FIG. 4B, a lap joint in which the inner surface of the side end 10*a* and the outer surface of the side end 10*b* of the body member 10A are bonded to each other, or as illustrated in FIG. 4C, an edge joint in which the inner surfaces of the side end 10*a* and the side end 10*b* of the body member 10A are bonded to each other. The lap joint or edge joint of the side end 10*a* and the side end 10*b* may be achieved by heat sealing or using an adhesive.

Figure 3A:
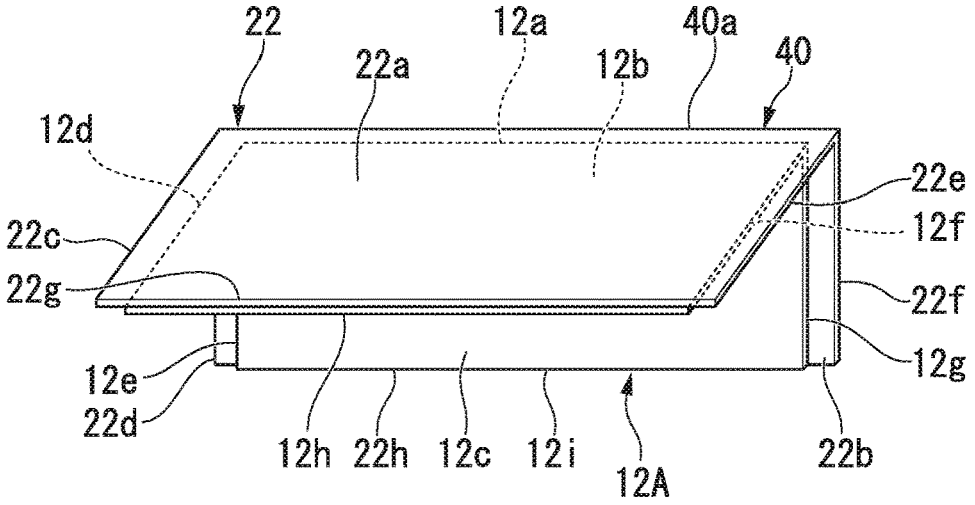
FIG. 3A is a view illustrating a step of manufacturing of the self-standing bag of the present: invention, and is a perspective view of a bottom member.

The bottom portion 12 is formed of the bottom member 12A having a rectangular film shape. Specifically, the bottom portion 12 is formed by attaching the bottom member 12A in a half-folded state to the inside of the body portion 10 with the folding line 12*a* on the upper side. As illustrated in FIG. 3A, the surface of the half-folded bottom member 12A is partitioned into a first bottom surface portion 12*b* and a second bottom surface portion 12*c* with the folding line 12*a* as the boundary, In the half-folded state, the side end 12*d* of the first bottom surface portion 12*b* and the side end 12*e* of the second bottom surface portion 12*c* are coincident with each other, the side end 12*f* of the first bottom surface portion 12*b* and the side end 12*g* of the second bottom surface portion 12*c* are coincident with each other, and the lower end 12*h* of the first bottom surface portion 12*b* and the lower end 12*i* of the second bottom surface portion 12*c* are coincident with each other.

Figure 3B:
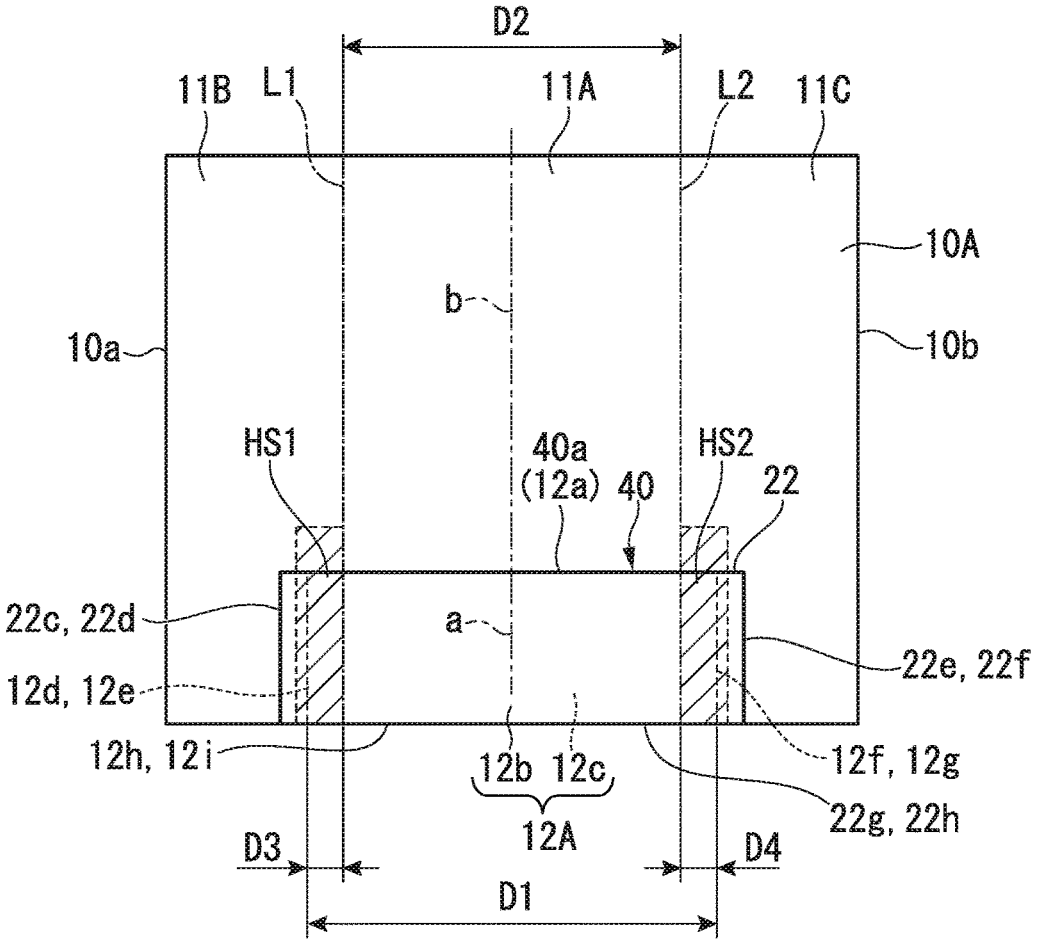
FIG. 3B is a view illustrating a step of the manufacturing of the self-standing bag of the present invention, and is a plan view of the self-standing bag which is developed.

As illustrated in FIG. 3B, in a process of manufacturing the self-standing bag 1, the bottom member 12A is half-folded and disposed on the body member 10A. That is, the second bottom surface portion 12*c* of the bottom member 12A is disposed to face the part 11A side of the body member 10A, and is positioned to face the front surface portion 18 of the body portion 10 when the self-standing bag 1 is formed. On the other hand, the first bottom surface portion 12*b* of the bottom member 12A is positioned to face the rear surface portion 20 side of the body portion 10 when the self-standing bag 1 is formed. The rear surface portion 20 of the body portion 10 is formed by the part 11B and the part 11C of the body member 10A.

As illustrated in FIG. 3B, when the half-folded bottom member 12A is disposed on the body member 10A, a center line a of the bottom member 12A in the width direction and a center line b of the body member 10A in the width direction are substantially coincident with each other. A length D1 between both side ends of the half-folded bottom member 12A is longer than a width D2 of the part 11A of the body member 10A and crosses the folding lines L1 and L2 of the body member 10A. Here, the folding lines L1 and L2 of the body member 10A indicate positions to be folded.

When the body member 10A is formed into a tubular shape, the bottom member 12A is also folded at the folding lines L1 and L2 of the body member 10A. That is, the length D1 between both side ends of the bottom member 12A is longer than the width of the body portion 10.

In a general self-standing bag having a body portion and a bottom portion and having a side portion seal formed outside a side edge of the body portion for bonding the body portion to a side portion, the load of the contents tends to be concentrated on the upper end of a side end part of a bottom member inside the self-standing bag. That is, the load of the contents tends to be concentrated on the corner of the side end where the bottom member is half-folded. Therefore, there is a possibility that breakage may occur at this part and the contents may leak.

In addition, in the self-standing bag 1, the side end of the bottom member may be coincident with the side edge of the body portion. However, even in this case, as described above, the side end of the bottom member is coincident with the inside of the side edge of the body portion, and the load of the contents tends to be concentrated particularly on the upper end of the bottom member, that is, the half-folded corner of the bottom member. Therefore, there is a possibility that breakage may occur at the upper portion of the side end of the bottom member and the contents may leak.

Figure 5A:
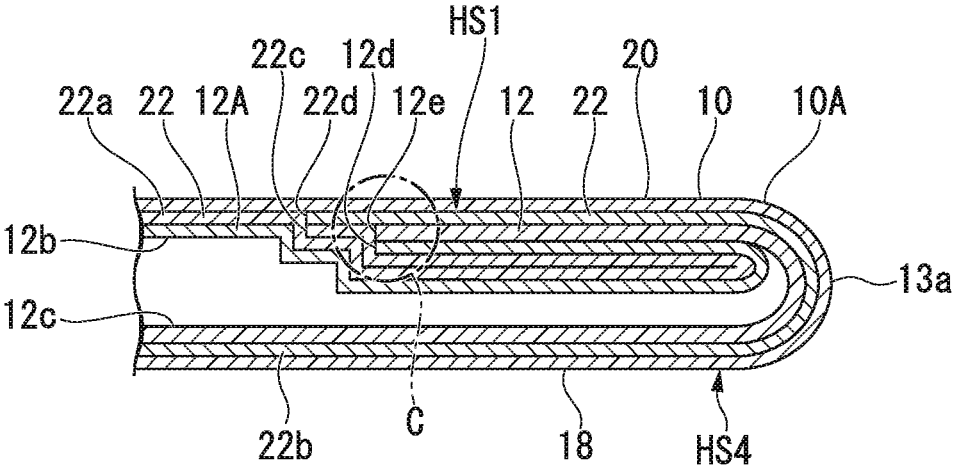
FIG. 5A is a cross-sectional view of the self-standing bag in FIG. 2 taken along line I-I.

However, in the self-standing bag 1, in a case where the length D1 between both the side ends of the bottom member 12A is longer than the width of the body portion 10, as illustrated in FIGS. 1, 2, and 5A, the side ends 12*d* and 12*e* side of the half-folded bottom member 12A is folded at the side edge 13*a* of the body portion 10 and is attached to the inner surface of the rear surface portion 20. Accordingly, in the self-standing bag 1, the folded part in the bottom member 12A other than the corner of the bottom member 12A half-folded at the folding line 12*a* receives the load of the contents, so that a large force is not concentrated on the side edge of the bottom member 12A on the side ends 12*d* and 12*e* sides. Therefore, it is difficult for parts of the side ends 12*d* and 12*e* to be broken, and the effect of suppressing leakage of the contents is high.

Similarly, the side ends 12*f* and 12*g* side of the half-folded bottom member 12A is folded at the side edge 13*b* of the body portion 10 and the side ends 12*f* and 12*g* is attached to the inner surface of the rear surface portion 20. Accordingly, it is difficult for parts of the side ends 12*f* and 12*g* to be broken, and the effect of suppressing leakage of the contents increases.

Figure 6:
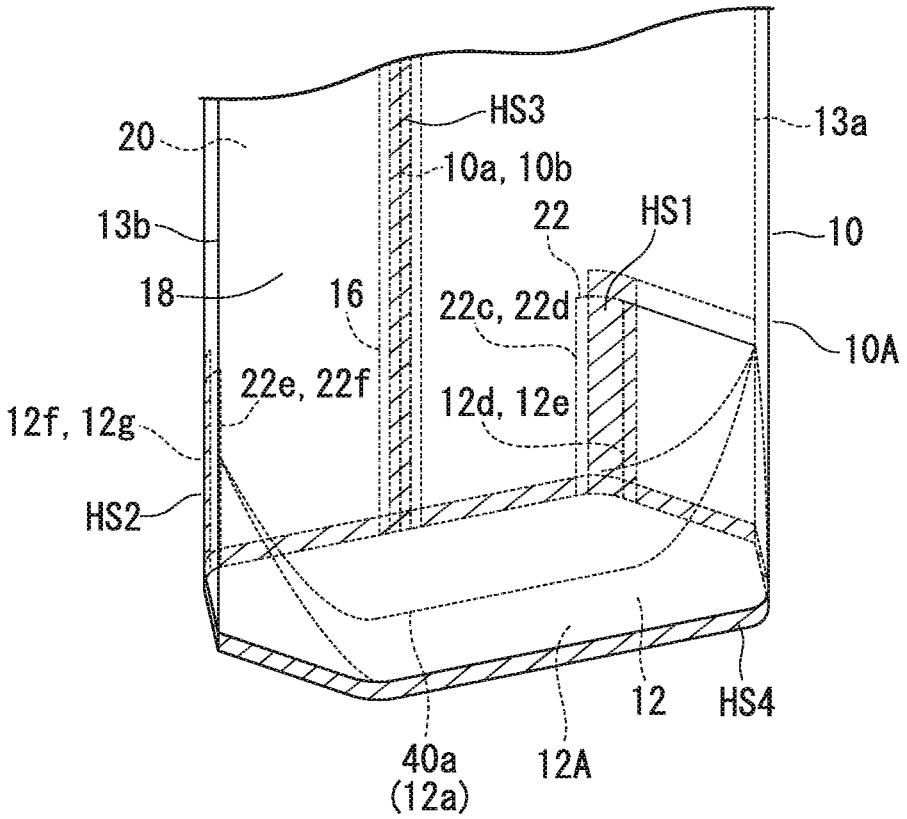
FIG. 6 is a perspective view partially illustrating another form in a state where contents of the self-standing bag of the present invention are stored.

The distance between the side ends 12*d* and 12*e* of the bottom member 12A and the side edge 13*a* of the body portion 10, that is, the distance D3 between the side ends 12*d* and 12*e* of the bottom member 12A and the folding line L1 of the body member 10A is preferably 1.0 mm or more, and more preferably 3.0 mm or more. When the distance D3 is 1.0 mm or more, leakage of the contents due to the breakage of the parts of the side ends 12*d* and 12*e* of the bottom member 12A can be easily suppressed. In a case where the distance D3 has a certain length, when the self-standing bag is charged with the contents, as illustrated in FIG. 6, the body member 10A is folded at positions of the body member 10A corresponding to the positions of the side ends 12*d* and 12*e* of the bottom member 12A as folding lines, so that a blunt corner portion is easily formed. This is easily formed in a case of using a laminate having rigidity, such as a laminate having metal such as an aluminum foil as the film for forming the body member and the bottom member. In addition, the certain length of the distance D3 in this case depends on the size of the self-standing bag, but the corner portion is easily formed in a case of having a distance of at least 10 mm or more.

A preferable range of the distance between the side ends 12*f* and 12*g* of the bottom member 12A and the side edge 13*b* of the body portion 10, that is, the distance D4 between the side ends 12*f* and 12*g* of the bottom member 12A and the folding line L2 of the body member 10A is the same as the distance D3.

The distance D3 and the distance D4 may be the same or different, but are preferably the same from the viewpoint of excellent outer appearance.

As the bottom member 12A, a laminated film in which at least a base material layer and a sealant layer are laminated is preferable, and is half-folded with the sealant layer on the outer side. The innermost layer on the side facing the inner surface of the body portion 10 inside the self-standing bag 1 is the sealant layer. As the base material layer and the sealant layer of the bottom member 12A, for example, the base material layer and the sealant layer adopted by the body member 10A can be adopted. In addition, in a case where the bottom member 12A is the laminated film, the bottom member 12A may have an intermediate layer. As the intermediate layer of the bottom member 12A, for example, the same intermediate layer adopted by the body member 10A can be adopted.

The bottom member 12A and the body member 10A may be films of the same material or films of different materials, but are preferably laminated films having the sealant layers made of the same kind of resin from the viewpoint of enabling bonding by heat sealing thereof.

In a case where a laminated film in which the bottom member and the adhesive film are integrated is used as a laminate of the bottom member and the adhesive film, which will be described later, the adhesive film may also serve as the sealant layer of the bottom member.

The side ends 12*d* and 12*e* and the side ends 12*f* and 12*g* of the bottom member 12A are bonded to the inner surface of the body portion 10 using the adhesive film 22.

Specifically, the rectangular adhesive film 22 is laminated on the bottom member 12A to cover the entire bottom member 12A. The adhesive film 22 is laminated on the surface of the sealant layer of the bottom member 12A. Here, "being laminated" may be a state where the bottom member 12A and the adhesive film 22 are bonded to each other over the entire surface or only partially bonded, and may also include a state where the bottom member 12A and the adhesive film 22 are not bonded to each other. In addition, the adhesive film 22 and the bottom member 12A are half-folded together so that the bottom member 12A is interposed by the adhesive film 22. The surface of the half-folded adhesive film 22 is partitioned into a first flat surface portion 22*a* and a second flat surface portion 22*b*. In the half-folded state, the side end 22*c* of the first flat surface portion 22*a* and the side end 22*d* of the second flat surface portion 22*b* are coincident with each other, the side end 22*e* of the first flat surface portion 22*a* and the side end 22*f* of the second flat surface portion 22*b* are coincident with each other, and a lower end 22*g* of the first flat surface portion 22*a* and a lower end 22*h* of the second flat surface portion 22*b* are coincident with each other. The second flat surface portion 22*b* of the adhesive film 22 is positioned on the part 11A side of the body member 10A, that is, positioned on the front surface portion 18 side of the body portion 10 when the self-standing bag 1 is formed. On the other hand, the first flat surface portion 22*a* of the adhesive film 22 is positioned on the rear surface portion 20 side of the body portion 10 when the self-standing bag 1 is formed.

As illustrated in FIG. 3A, the side ends 22*c* and 22*d* on one side of the half-folded adhesive film 22 protrude from the side ends 12*d* and 12*e* on one side of the half-folded bottom member 12A in the width direction. In addition, the side ends 22*e* and 22*f* on the other side of the half-folded adhesive film 22 protrude from the side ends 12*f* and 12*g* on the other side of the half-folded bottom member 12A. As described above, the side ends 22*c* and 22*d* and the side ends 22*e* and 22*f* on both sides of the adhesive film 22 protrude from the bottom member 12A in the width direction.

Figure 5B:
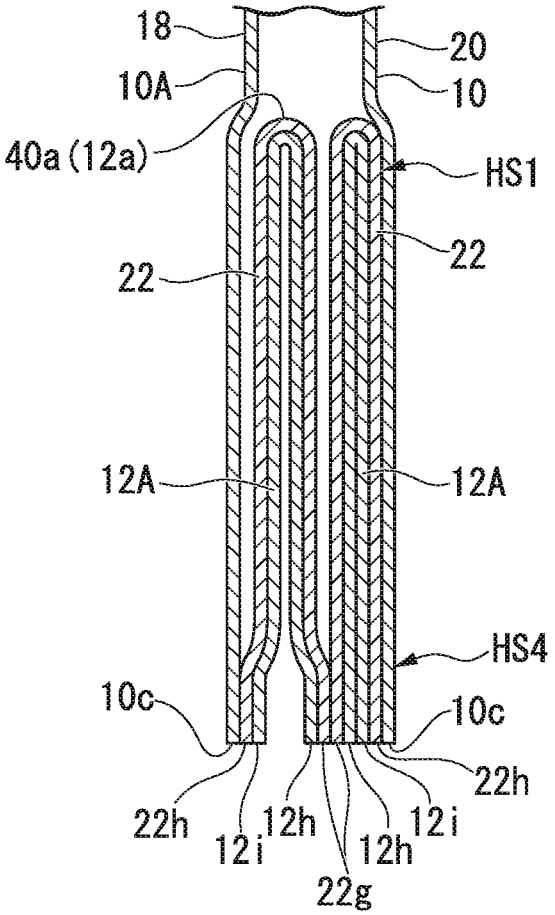
FIG. 5B is a cross-sectional view of the self-standing bag in FIG. 2 taken along line II-II.

As illustrated in FIGS. 1, 2, and 5B, in the self-standing bag 1, in a state where the side ends 22*c* and 22*d* side of the adhesive film 22 and the side ends 12*d* and 12*e* side of the bottom member 12A are folded at the side edge 13*a* of the body portion 10, the adhesive film 22, the bottom member 12A, and the body portion 10 are bonded by heat sealing at a heat-sealed portion HS1 including the side ends 12*d* and 12*e* of the bottom member 12A. Specifically, in the heat-sealed portion HS1 the adhesive film 22 and the bottom member 12A are bonded to each other, the adhesive film 22 and the rear surface portion 20 of the body portion 10 are bonded to each other, and furthermore, parts of the adhesive film 22 protruding from the bottom member 12A are bonded to each other, whereby the side ends 12*d* and 12*e* of the bottom member 12A are closed by the adhesive film 22 and are attached to the inner surface of the rear surface portion 20 of the body portion 10 by bonding. An end of the heat-sealed portion HS1 in the height direction is formed to cross the half-folded folding line 12*a* of the bottom member 12A. In addition, an end of the heat-sealed portion HS1 in the width direction will be described later.

Similarly, in a state where the side ends 22*e* and 22*f* side of the adhesive film 22 and the side ends 12*f* and 12*g* side of the bottom member 12A are folded at the side edge 13*b* of the body portion 10, the adhesive film 22, the bottom member 12A, and the body portion 10 are bonded by heat sealing at a heat-sealed portion HS2 including the side ends 12*f* and 12*g* of the bottom member 12A. Specifically, in the heat-sealed portion HS2, the adhesive film 22 and the bottom member 12A are bonded to each other, the adhesive film 22 and the rear surface portion 20 of the body portion 10 are bonded to each other, and furthermore, parts of the adhesive film 22 protruding from the bottom member 12A are bonded to each other, whereby the side ends 12*f* and 12*g* of the bottom member 12A are closed by the adhesive film 22 and are attached to the inner surface of the rear surface portion 20 of the body portion 10 by bonding. An end of the heat-sealed portion HS2 in the height direction is formed to cross the half-folded folding line 12*a* of the bottom member 12A. In addition, an end of the heat-sealed portion HS2 in the width direction will be described later.

In the self-standing bag 1, the bottom member 12A and the adhesive film 22 are laminated as described above, and both the side ends 22*c* and 22*d* and the side ends 22*e* and 22*f* of the adhesive film 22 protrude respectively from both the side ends 12*d* and 12*e* and the side ends 12*f* and 120 of the bottom member 12A in the width direction, and the adhesive film 22 is a single sheet, so that the positional relationship between the bottom member 12A and the adhesive film 22 can be easily controlled. Therefore, even if the self-standing bag 1 is small in size, bonding failure due to deviation in position between the bottom member 12A and the adhesive film 22 is sufficiently suppressed. Accordingly, leakage of the contents is stably suppressed regardless of size.

In addition, in the self-standing bag 1, since the bottom member 12A and the adhesive film 22 are laminated, compared to a form in which the adhesive film is laminated only on the side end part of the bottom member 12A, excellent pinhole resistance is obtained for the entire bottom portion 12. From the viewpoint of excellent pinhole resistance, it is preferable that the bottom member and the adhesive film be bonded only at both side end parts of the bottom member so as to be laminated. In the self-standing bag 1, the bottom member 12A and the adhesive film 22 are bonded at both the side end parts of the bottom member, are bonded at the heat-sealed portion HS1 and the heat-sealed portion HS2, and are not bonded to each other at the center part in the width direction. Therefore, the center portion in the width direction is like a double bag, and the self-standing bag 1 is superior in the pinhole resistance of the bottom portion 12 to a case where the bottom member 12A and the adhesive film 22 are entirely bonded to each other.

The adhesive film 22 is a member having a function of attaching the side ends 12*d* to 12*g* on both sides of the bottom member 12A to the inner surface of the body portion 10 by bonding, and is a film having a heat-sealable property on both surfaces. As the adhesive film 22, an adhesive film which has a sealable property capable of being thermally fused to the sealant layers of the body member and the bottom member and is made of the same material as the film employed by the adhesive film 16 can be used, and from the viewpoint of being entirely melted in the thickness direction by heat of heat sealing and thus further reduced in thickness, a single layer synthetic resin film is preferable. In addition, when the adhesive film 22 is the single layer synthetic resin film, in the heat-sealed portion HS1 and the heat-sealed portion HS2, the adhesive film 22 is melted by heat of heat sealing and easily infiltrates into a stepped part at the boundary between side ends 12*d* and 12*e* and between the side ends 12*f* and 12*g* of the bottom member 12A, so that heat sealing failure is less likely to occur.

In the self-standing bag of this example, as illustrated in FIG. 3B, in the parts 11B and 11C of the body member 10A, one end of the heat-sealed portion HS1 in the width direction is formed to reach the folding line L1, and one end of the heat-sealed portion HS2 in the width direction is formed to reach the folding line L2.

That is, in the rear surface portion 20 of the body portion 10, the heat-sealed portion HS1 is formed to reach the side edge 13*a* of the body portion 10, and the heat-sealed portion HS2 is formed to reach the side edge 13*b* of the body portion 10. In the self-standing bag 1, parts of the body portion 10 which are bonded to the adhesive film 22 at parts to which both the side ends 12*d* and 12*e* and the side ends 12*f* and 12*g* of the bottom member 12A are attached do not cross the folding lines L1 and L2 and are preferably in only the rear surface portion 20. That is, it is preferable that the heat-sealed portion HS1 and the heat-sealed portion HS2 do not reach the front surface portion 18. Accordingly, the folding line 12*a* of the bottom member 12A is in a state of not being fixed to the front surface portion 18 of the body portion 10. Therefore, in the vicinity of the side edges 13*a* and 13*b* of the self-standing bag 1, the upper portion of the bottom portion 12 easily widens, and correspondingly the vicinity of the side edges 13*a* and 13*b* of the body portion 10 easily widens, whereby the self-standing stability is improved and good outer appearance is easily obtained.

Figure 8:
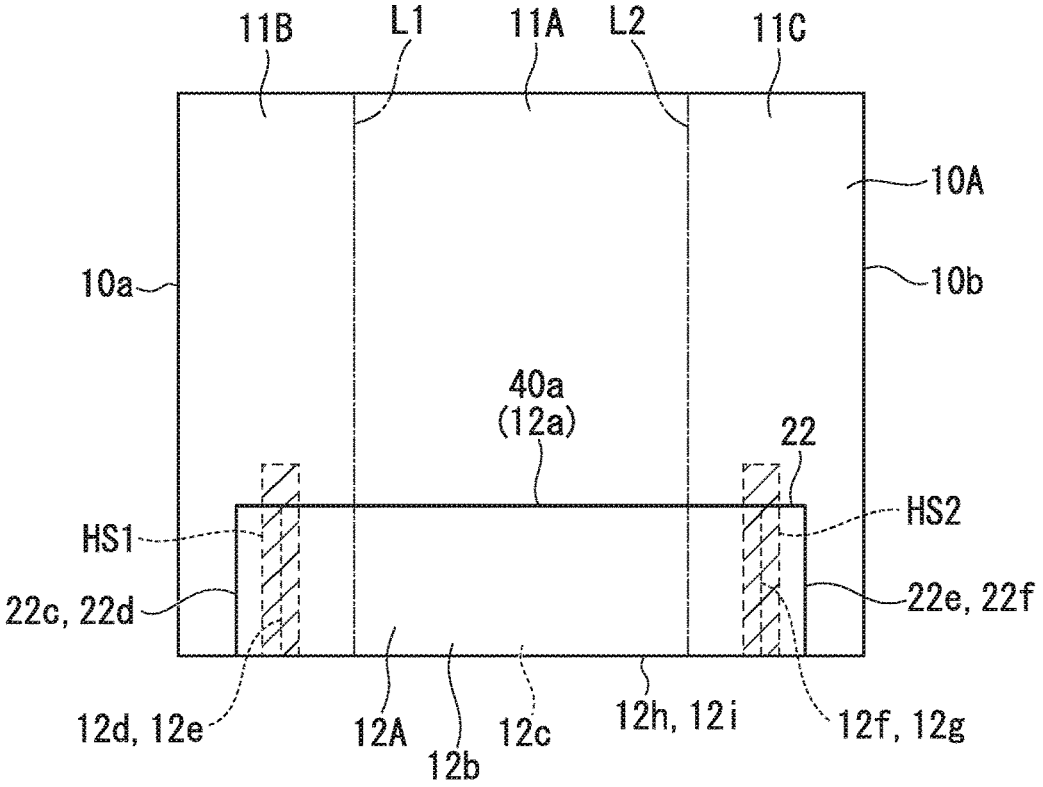
FIG. 8 is a plan view illustrating a step of manufacturing of another example of the self-standing hag of the present invention.

In addition, in a case where the heat-sealed portion HS1 and the heat-sealed portion HS2 are formed only in the rear surface portion 20, as illustrated in FIG. 8, one end of the heat-sealed portion HS1 in the width direction may not reach the folding line L1, and one end of the heat-sealed portion HS2 in the width direction may not reach the folding line L2. That is, the heat-sealed portion HS1 and the heat-sealed portion HS2 may not reach the side edges 13*a* and 13*b* of the body portion 10. Even in this case, the upper portion of the bottom portion 12 easily widens in the vicinity of the side edges 13*a* and 13*b* of the self-standing bag 1, and correspondingly the vicinity of the side edges 13*a* and 13*b* of the body portion 10 easily widens, hereby the self-standing stability is improved and good outer appearance is easily obtained.

Figure 9:
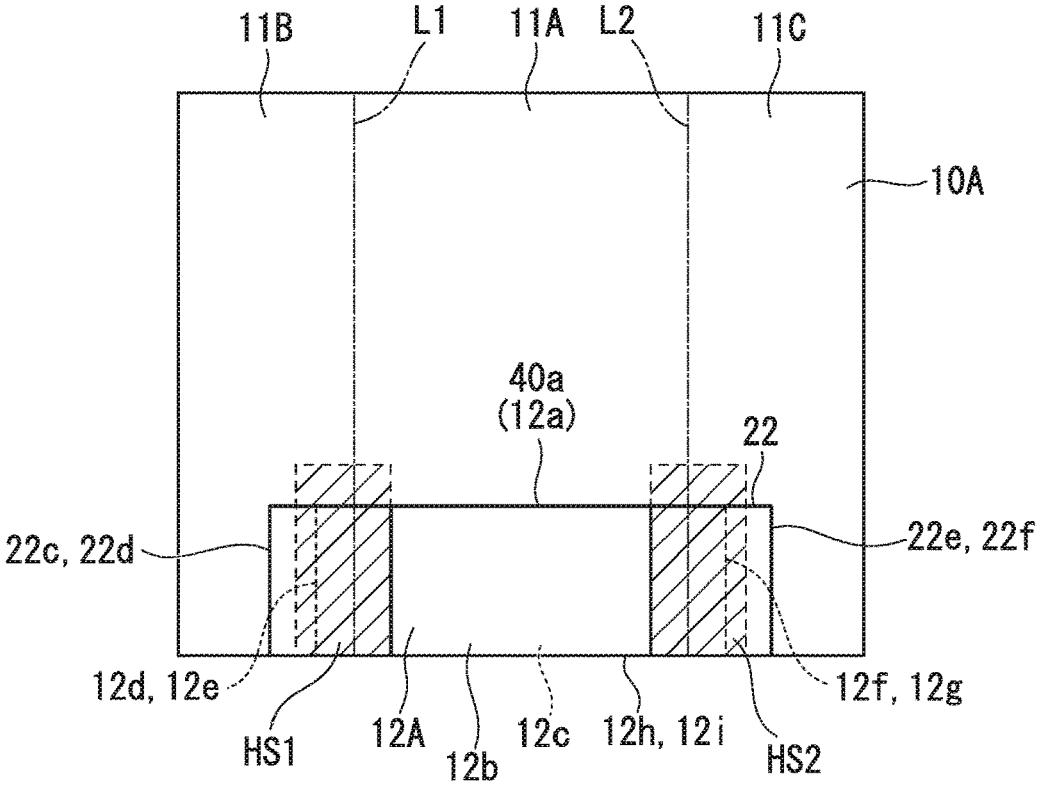
FIG. 9 is a plan view illustrating a step of manufacturing of another example of the self-standing bag of the present invention.

In addition, as illustrated in FIG. 9, as long as the self-standing stability and designability are not in excessively low ranges, a form is achieved in which one ends of the heat-sealed portion HS1 and the heat-sealed portion HS2 in the width direction respectively cross the folding line L1 and the folding line L2 and reach the part 11A of the body member 10A, that is, the front surface portion 18 of the body portion 10.

The other ends of the heat-sealed portions HS1 and HS2 in the width direction may respectively cross the side ends 12*d* and 12*e* and the side ends 12*f* and 12*g* of the bottom member 12A. As the heat-sealed portions HS1 and HS2 cross the side ends 12*d* and 12*e* and the side ends 12*f* and 12*g* of the bottom member 12A, parts of the adhesive film 22 protruding from the side ends 12*d* and 12*e* of the bottom member 12A are bonded to each other and parts protruding from the side ends 12*f* and 12*g* are bonded to each other. Accordingly, the side end 12*d* and the side end 12*e* of the bottom member 12A are closed, and the side end 12*f* and the side end 12*g* are closed.

In addition, the other ends of the heat-sealed portions HS1 and HS2 in the width direction may respectively cross the side ends 22*c* and 22*d* and the side ends 22*e* and 22*f* of the adhesive film 22. As the heat-sealed portions HS1 and HS2 cross the side ends 22*c* and 22*d* and the side ends 22*e* and 22*f* of the adhesive film 22, the side end 22*c* and the side end 22*d* are closed, and the side end 22*e* and the side end 22*f* are closed. Accordingly, it is possible to prevent the contents from being incorporated between the side end 22*c* and the side end 22*d* and between the side end 22*e* and the side end 22*f*.

In the self-standing bag 1, as illustrated in FIGS. 1, 2, 5A, and 5B, the lower ends 12*h* and 12*i* of the half-folded bottom member 12A and the lower end side of the body member 10A are heat-sealed over the entire circumference of the body portion 10, whereby a band-like heat-sealed portion HS4 is formed. The band-like heat-sealed portion HS4 is formed on the inner side of the body portion, and when the heat-sealed portion HS4 reaches the lowermost end on the lower end side of the body member 10A, the self-standing properties are improved, which is preferable. Accordingly, the lower end side of the self-standing bag 1 is closed and the bottom portion 12 is formed. The width of the band-like heat-scaled portion HS4 is preferably 2 mm to 30 mm, and more preferably 3 mm to 10 mm.

A part of the front surface portion 18 of the body portion 10 above the heat-sealed portion HS4 is not bonded to the adhesive film 22. In addition, the first flat surface portion 22*a* and the second flat surface portion 22*b* which are in contact with each other in a folded state in the adhesive film 22 are bonded to each other at the heat-sealed portion HS4.

The upper portion of the body portion 10 is heat-sealed at a heat-sealed portion HS5 in a state in which the spout 14 is interposed between the front surface portion 18 and the rear surface portion 20, so that the spout 14 is sealed in a liquid-tightly attached state.

As the spout 14 a known spout can be used.

The spout 14 in this example has a lower portion inserted into the body portion 10, and includes a pouring pipe 24 through which the contents are poured froth the spout, and a cap 26 which is screwed to the upper portion of the pouring pipe 24 to close the spout of the pouring pipe 24.

As the material of the spout 14, a part of the pouring pipe 24 that is bonded to at least the inner surface of the body portion 10 is preferably made of a synthetic resin.

Examples of the synthetic resin forming the part of the pouring pipe 24 of the spout 14 that is bonded to at least the inner surface of the body portion 10 include a polyolefin resin, a polyamide resin, a polyester resin, a (meth)acrylic resin, a vinyl chloride resin, a vinylidene chloride resin, polyethersulfone, and ethylene-vinyl alcohol copolymer, and the like. Particularly, a polyolefin resin is preferable from the viewpoint of excellent processability and low cost.

Examples of the polyolefin resin include polyethylene resins such as high-density polyethylene, medium-density polyethylene, high-pressure method low-density polyethylene, linear low-density polyethylene, and ethylene-vinyl acetate copolymer, olefin-based elastomers such as ethylene-α-olefin copolymer, polypropylene-based resins such as polypropylene, ethylene-propylene random copolymer, and α-olefin-propylene random copolymer, and cyclic polyolefin resins. These resins may be blended for improvement in performance, and may be partially crosslinked for the purpose of improving heat resistance or the like.

The spout 14 may be formed of a single material, or may be formed to have a multilayer structure made of various resin layers.

From the viewpoint of adhesiveness, the resin forming the part of the pouring pipe 24 of the spout 14 that is bonded to at least the inner surface of the body portion 10 is preferably formed of the same kind of resin as the resin forming the sealant layers on the inner surface side of the front surface portion 18 and the rear surface portion 20 of the body portion 10.

The self-standing bag of the present invention is provided with or is not provided with the spout, and can be suitably used as a bag that stores foods, fluids such as cosmetics and shampoos, powders, solids, and the like. In addition, the self-standing bag of the present invention may also be used as an outer packaging bag for packaging individual packages.

In the self-standing bag of the present invention described above, in the state where the bottom member and the adhesive film are laminated, bonding of the side end of the bottom member to the inner surface of the body portion is achieved by the adhesive film. Therefore, excellent pinhole resistance is obtained by the entire bottom portion. In addition, both the side ends of the adhesive film protrude from both the side ends of the bottom member in the width direction. Therefore, the positional relationship between the bottom member and the adhesive film can be easily controlled. Accordingly, even in a self-standing bag with a small size, bonding failure due to deviation of the position of the adhesive film can be easily suppressed, and leakage of the contents is stably suppressed.

In addition, in the self-standing bag of the present invention, a heat-sealed portion at which the inner surfaces of the front surface portion and the rear surface portion are bonded to each other is not formed at the side edge of the body portion. Therefore, there is no discomfort even if the body portion is grasped by hand, and excellent outer appearance is achieved.

The self-standing bag of the present invention is not limited to the above-described self-standing bag 1.

For example, in the self-standing bag 1, the center line a of the bottom member 12A in the width direction and the center line b of the body member 10A in the width direction are substantially coincident with each other. However, the center line a of the bottom member 12A in the width direction and the center line b of the body member 10A in the width direction may not be substantially coincident with each other as long as both the side ends 12*d* and 12*e* and the side ends 12*f* and 12*g* of the bottom member 12A in the width direction are in ranges that reach the folding lines L1 and L2 of the body member 10A.

In addition, in the self-standing bag 1, although the rear joint 15 is formed at the center of the rear surface portion 20 in the width direction, the position at which the rear joint 15 is formed is not limited to the center part of the rear surface portion 20 in the width direction. The self-standing bag of the present invention may be a self-standing bag in which the rear joint 15 is formed closer to the side edge 13*a* or the side edge 13*b* than the center of the rear surface portion 20 in the width direction. Such a self-standing bag can be manufactured by the same method as in the self-standing bag 1, which will be described later, except that the positions in the width direction of the folding lines L1 and L2 at which the body member 10A is folded are set to positions close to the side end 10*a* or the side end 10*b*, and correspondingly the disposition positions of the bottom member 12A and the adhesive film 22 disposed on the body member 10A are disposed so as not to cause the center line a of the bottom member 12A in the width direction and the center line b of the body member 10A in the width direction to be substantially coincident with each other but are disposed at positions close to the side end 10*a* or the side end 10*b*.

In addition, the adhesive films 16 and 22 are not limited to the film having a heat-sealable property on both surfaces. For example, as the adhesive films 16 and 22, an adhesive film in which an adhesive layer is formed by an adhesive without having a heat-sealable property may be used.

Figure 10A:
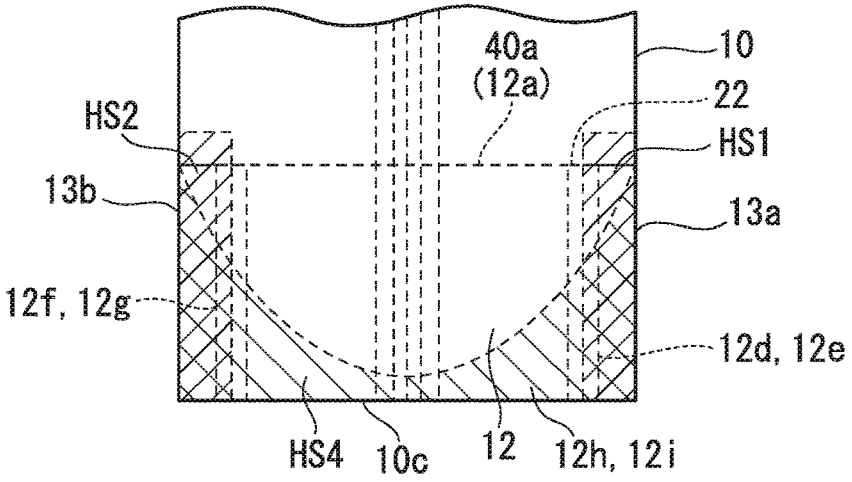
FIG. 10A is a front view illustrating a flat state of an example of another embodiment of the self-standing bag of the present invention.
Figure 10B:
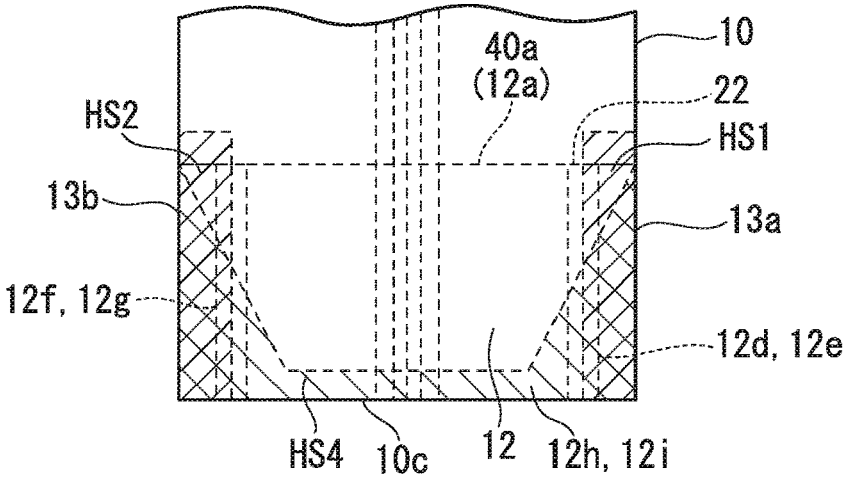
FIG. 10B is a front view illustrating a flat state of an example of another embodiment of the self-standing bag of the present invention.
Figure 10C:
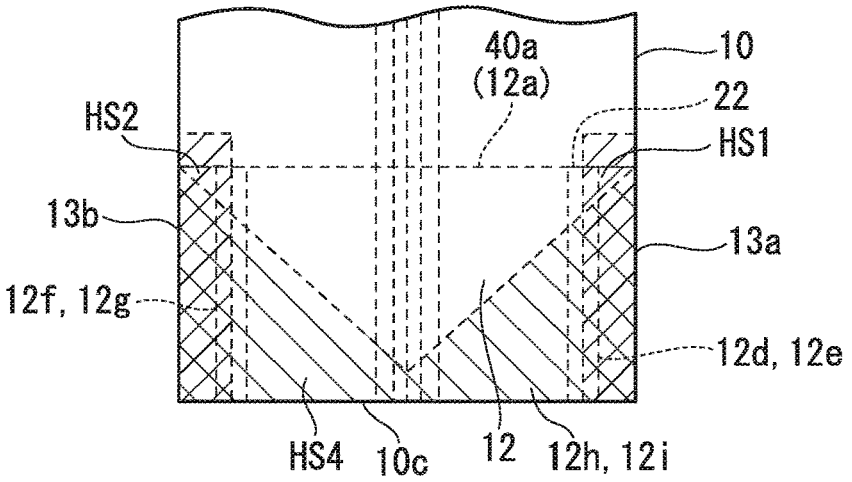
FIG. 10C is a front view illustrating a flat state of an example of another embodiment of the self-standing bag of the present invention.

Furthermore, as illustrated in FIG. 10A, the shape of the heat-sealed portion HS4 at which the lower ends 12*h* and 12*i* of the bottom member 12A and a lower end 10*c* of the body portion 10 are bonded to each other may be set so that the shape of the upper edge thereof is an arc shape in order to open the bottom portion without looseness when the contents are filled and to obtain excellent self-standing stability. In addition, as illustrated in FIG. 10B, the shape of the upper edge of the heat-sealed portion HS4 may be heat-sealed to be a folded line shape formed of three sides including a side inclined from the side edge 13*a* of the body portion 10 toward the lower end 10*c*, a side parallel to the lower end 10*c*, and a side inclined from the lower end 10*c* toward the side edge 13*b*. In addition, as illustrated in FIG. 10C, the shape of the upper edge of the heat-sealed portion HS4 may be heat-sealed to be a folded line shape formed of two sides including a side inclined from the side edge 13*a* of die body portion 10 toward the center of the lower end 10*c*, and a side inclined from the center of the lower end 10*c* toward the side edge 13*b*. In addition, when the heat-sealed portion HS4 illustrated in FIGS. 10A, 10B, and 10C is bonded over the entire surface, there is a possibility that wrinkles may be generated. Therefore, an unsealed portion may be provided in a range in which the contents do not leak.

In a case of the heat-sealed portion. HS4 as illustrated in FIGS. 10A, 10B, and 10C, in a flat state, the upper end of the heat-sealed portion HS4 is preferably coincident with or below the folding line 12*a* of the bottom member 12A. In a case where the upper end of the heat-sealed portion HS4 is above the folding line 12*a* of the bottom member 12A, the inner surfaces of the front surface portion 18 and the rear surface portion 20 of the body portion 10 are integrated by heat sealing on the side above the folding line 12*a* in the heat-sealed portion HS4. Therefore, the part acts as a knife edge and may cause discomfort when grasped by hand. Contrary to this, in a case where the upper end of the heat-sealed portion HS4 is coincident with or below the folding line 12*a* of the bottom member 12A, since the bottom member 12A is half-folded in a state where the base material layers face each other, the facing surfaces are not bonded to each other, and the front surface portion 18 and the rear surface portion 20 of the body portion 10 are not integrated at the side edges 13*a* and 13*b* of the self-standing bag. Therefore, a part that causes discomfort when grasped by hand is not present, which is preferable.

In addition, in the self-standing bag 1, the side ends 12*d* and 12*e* and the side ends 12*f* and 12*g* of the bottom member 12A are bonded to the inner surface of the rear surface portion 20. However, a self-standing bag in which the side ends 12*d* and 12*e* and the side ends 12*f* and 12*g* of the bottom member 12A are bonded to the inner surface of the front surface portion 18 may also be adopted. Alternatively, a self-standing hag in which one of the side ends 12*d* and 12*e* and the side ends 12*f* and 12*g* of the bottom member 12A are bonded to the inner surface of the front surface portion 18 and the other are bonded to the inner surface of the rear surface portion 20 may also be adopted.

Furthermore, in the self-standing bag 1, as illustrated in FIG. 5B, the lowermost end of the lower ends 12*h* and 12*i* of the hall-folded bottom member 12A and the lowermost end of the lower end 10*c* of the body member 10A are coincident with each other but may deviate from each other.

The body portion in the self-standing bag of the present invention is not limited to the form in which, as described above, the body member is formed in a tubular shape to form the rear joint and may also be a body portion formed by a tubular film obtained by inflation molding.

The self-standing bag of the present invention is not limited to the form in which the spout is provided. For example, the self-standing bag may be a self-standing bag in which the upper portion of the body portion 10 is open, or may be a self-standing bag in which a lid portion having the same form as the bottom portion in the present invention is formed at the upper end of the body portion 10.

[Manufacturing. Method of Self-Standing Bag]

Hereinafter, a method for manufacturing a self-standing bag of the present invention has:

a step (I) of forming a laminate by laminating a film-like bottom member and an adhesive film to cause both side edges of the adhesive film in a width direction to protrude from both side edges of the bottom member in the width direction;

a step (II) of half-folding the laminate at a folding line of the bottom member extending in the width direction so as to cause the adhesive film to be on the outside;

a step (III) of placing the half-folded laminate on a film-like body member;

a step (IV) of attaching a side end of the bottom member to the body member by the adhesive film;

a step (V) of forming a body portion by bonding side ends of the body member to each other into a tubular shape so as to cause a surface of the body member bonded to the bottom member to be an inner surface; and a step (VI) of forming a bottom portion by bonding a lower end of the bottom member and a lower end side of the body portion on an entire circumference of the body portion.

Hereinafter, as an example of the method for manufacturing a self-standing bag, a method for manufacturing the self-standing bag 1 having a spout in a case where laminated films in which a sealant layer and a base material layer are laminated are used as both the body member 10A and the bottom member 12A will be described. The method for manufacturing the self-standing bag 1 has the following steps (I) to (VII):

a step (1) of forming a laminate 40 by laminating the bottom member 12A and the adhesive film 22 to cause both the side ends 22*c* and 22*d* and the side ends 22*e* and 22*f* of the adhesive film 22 in the width direction to respectively protrude from both the side ends 12*d* and 12*e* and the side ends 12*f* and 12*g* of the bottom member 12A in the width direction;

a step (II) of half-folding the laminate 40 at a folding line 40*a* of the bottom member 12A extending in the width direction so as to cause the adhesive film 22 to be on the outside;

a step (III) of placing the half-folded laminate 40 on the film-like body member 10A;

a step (IV) of attaching the side ends 12*d* and 12*e* and the side ends 12*f* and 12*g* of the bottom member 12A to the body member 10A by the adhesive film 22;

a step (V) of forming the body portion 10 by bonding the side ends 10*a* and 10*b* of the body member 10A to each other into a tubular shape so as to cause the surface of the body member 10A bonded to the bottom member 12A to be an inner surface;

a step (VI) of forming the bottom portion 12 by bonding the lower ends 12*h* and 12*i* of the bottom member 12A and the lower end 10*c* side of the body portion 10 over the entire circumference of the body portion 10; and (VII) liquid-tightly sealing the spout 14 with the upper portion of the body portion 10.

Hereinafter, each step will be described in detail.

Step (I):

As illustrated in FIG. 3A, the laminate 40 is formed by laminating the bottom member 12A and an adhesive film 22A so as to cause both the side ends 22*c* and 22*d* and the side ends 22*e* and 22*f* of the adhesive film 22 to respectively protrude from both the side ends 12*d* and 12*e* and the side ends 12*f* and 12*g* of the bottom member 12A in the width direction. In a case where the bottom member 12A has a sealant layer, the bottom member 12A and the adhesive film 22A are laminated so that the sealant layer of the bottom member 12A faces the adhesive film 22 side.

In the step (I), it is preferable to form the laminate 40 by bonding the bottom member 12A and the adhesive film 22 along each of both the side ends 12*d* and 12*e* and the side ends 12*f* and 12*g* of the bottom member 12A. By forming the laminate 40 in this manner, control of the positional relationship between the bottom member 12A and the adhesive film 22 is further facilitated, and the self-standing bag 1 in which leakage of the contents is suppressed can be more stably obtained even if the size thereof is small.

Figure 7:
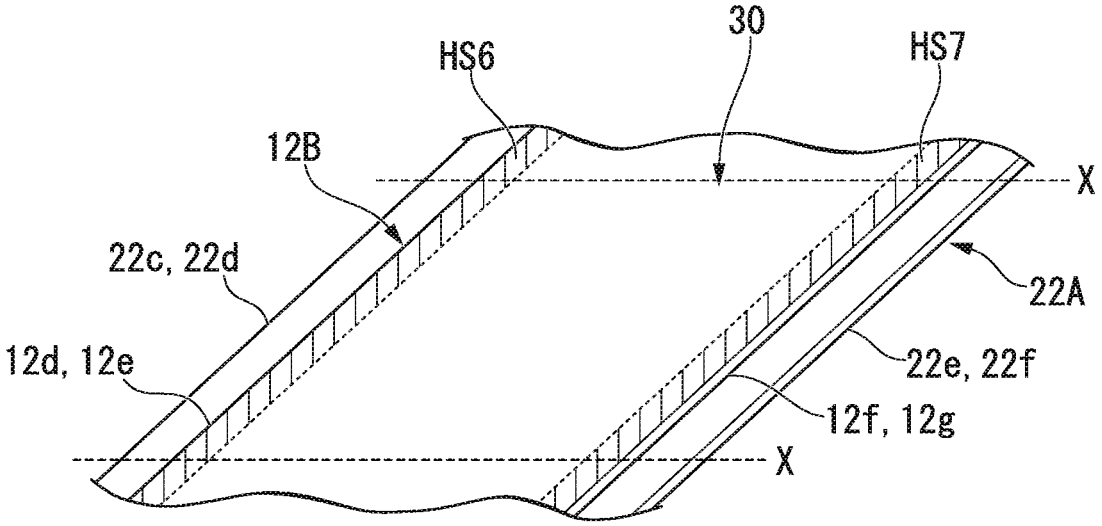
FIG. 7 is a perspective view illustrating a step of an example of a method for manufacturing the self-standing bag of the present invention.

For example, it is preferable to perform a step illustrated in FIG. 7. While a bottom member 12B which is long and the adhesive film 22A which is long are transported, a surface of the sealant layer of the bottom member 12B and one surface of the adhesive film 22A are laminated to face each other so that both the side ends 22*c* and 22*d* and the side ends 22*e* and 22*f* of the adhesive film 22A respectively protrude from both the side ends 12*d* and 12*e* and the side ends 12*f* and 12*g* of the bottom member 12B in the width direction. Next, heat sealing is performed along both the side ends 12*d* and 12*e* of the bottom member 12B to form a heat-sealed portion HS6, and heat sealing is performed along the side ends 12*f* and 12*g* to form a heat-sealed portion HS7, thereby forming a laminate 30 of the bottom member 12B and the adhesive film 22A. Next, the laminate 30 is cut along the width direction (X direction in FIG. 7) with a predetermined interval in the longitudinal direction, thereby obtaining the laminate 40 in which the bottom member 12A and the adhesive film 22 are bonded along both the side ends 12*d* and 12*e* and the side ends 12*f* and 12*g* of the bottom member 12A.

In a case of forming the laminate 40, an adhesive may be used for bonding between the bottom member and the adhesive film.

Step (II):

Next, the laminate 40 of the bottom member 12A and the adhesive film 22 obtained in the step (I) is half-folded at the folding line 40*a* extending in the width direction so as to cause the adhesive film 22 to be on the outside.

The folding line 40*a* extending in the width direction of the laminate 40 is coincident with the folding line 12*a* of the bottom member 12A. In the bottom member 12A in the half-folded laminate 40, with the half-folded folding line 12*a* as the upper end, the side end 12*d* of the first bottom surface portion 12*b* and the side end 12*e* of the second bottom surface portion 12*c* are caused to be coincident with each other, the side end 12*f* of the first bottom surface portion 12*b* and the side end 12*g* of the second bottom surface portion 12*c* are caused to be coincident with each other, and the lower end 12*h* of the first bottom surface portion 12*b* and the lower end 12*i* of the second bottom surface portion 12*c* are caused to be coincident with each other. Also in the adhesive film 22 in the half-folded laminate 40, the side end 22*c* of the first flat surface portion 22*a* and the side end 22*d* of the second flat surface portion 22*b* are caused to be coincident with each other, the side end 22*e* of the first flat surface portion 22*a* and the side end 22*f* of the second flat surface portion 22*b* are caused to be coincident with each other, and the lower end 22*g* of the first flat surface portion 22*a* and the lower end 22*h* of the second flat surface portion 22*b* are caused to be coincident with each other.

Step (III):

Next, as illustrated in FIG. 3B, on the sealant layer of the body member 10A, the half-folded laminate 40 consisting of the bottom member 12A and the adhesive film 22A is placed. At this time, it is preferable to cause the side of the laminate 40 opposing the folding line 40*a*, that is, the lower ends 12*h* and 12*i* of the bottom member 12A and the lower ends 22*g* and 22*h* of the adhesive film 22 when the self-standing bag 1 is formed, to be coincident with the lower end 10*c* of the body member 10A when the self-standing bag 1 is formed. In addition, in this example, the laminate 40 is set so that the side ends 12*d* and 12*e* of the bottom member 12A are positioned in the part 11B on the side closer to the side end 10*a* side than the folding line L1 at which the body member 10A is folded. Similarly, the side ends 12*f* and 12*g* of the bottom member 12A are disposed to be positioned in the part 11C on the side closer to the side end 10*b* side than the folding line L2 at which the body member 10A is folded.

The body member 10A and the laminate 40 may be temporarily fixed to each other when the laminate 40 is disposed on the body member 10A. It is preferable that the temporary fixing position be a position overlapping any of the heat-sealed portions HS1, HS2 and HS4.

Step (IV):

As illustrated in FIG. 3B, the heat-sealed portion HS1 is formed by heat-sealing, the laminate 40 and the body member 10A in the part 11B of the body member 10A in a range crossing the upper end of the bottom member 12A so that the side ends 12*d* and 12*e* of a bottom member 20A are included in the entire range from the folding line 12*a* to the lower ends 12*h* and 12*i*. In the heat-sealed portion HS1, the adhesive film 22 and the bottom member 12A are bonded to each other, the adhesive film 22 and the part 11B of the body member 10A are bonded to each other, and the parts of the adhesive film 22 protruding from the bottom member 20A are bonded to each other. Accordingly, the side ends 12*d* and 12*e* of the bottom member 12A are closed by the adhesive film 22, and are attached onto the sealant layer of the part 11B of the body member 10A by bonding. The surface of the body member 10A on the sealant layer side becomes the inner surface of the body portion 10 when the self-standing bag 1 is formed. The side ends 12*d* and 12*e* of the bottom member 12A are not bonded to each other because the base material layers thereof are in close contact with each other.

Similarly, the heat-sealed portion HS2 is formed by heat-sealing the laminate 40 and the body member 10A in the part 11C of the body member 10A in a range crossing the upper end of the bottom member 12A so that the side ends 12*f* and 12*g* of the bottom member 20A are included in the entire range from the folding line 12*a* to the lower ends 12*h* and 12*i*. In the heat-sealed portion HS2, the adhesive film 22 and the bottom member 12A are bonded to each other, the adhesive film 22 and the part 11C of the body member 10A are bonded to each other, and the parts of the adhesive film 22 protruding from the bottom member 20A are bonded to each other. Accordingly, the side ends 12*f* and 12*g* of the bottom member 12A are closed by the adhesive film 22, and are attached onto the sealant layer of the part 11C of the body member 10A by bonding. The surface of the body member 10A on the sealant layer side becomes the inner surface of the body portion 10 when the self-standing bag 1 is formed. The side ends 12*f* and 12*g* of the bottom member 12A are not bonded to each other because the base material layers thereof are in close contact with each other.

Step (V):

The side end 10*a* side and the side end 10*b* side of the body member 10A are folded together with the side end sides of the bottom member 12A and the adhesive film 22 along the folding lines L1 and L2 positioned closer to the center than both the side ends 12*d* and 12*e* and the side ends 12*f* and 12*g* of the bottom member 12A so that the surface of the body member 10A bonded to the bottom member 12A becomes the inner surface. Here, folding can be easily performed by causing one ends of the heat-sealed portions HS1 and HS2 in the width direction to be coincident with the folding lines L1 and L2. Next, as illustrated in FIG. 4A, the side end 10*a* and the side end 10*b* are caused to abut each other, and the adhesive film 16 is caused to overlap with the inner surfaces thereof, and the heat-sealed portion HS3 is formed by heat-sealing, whereby the rear joint 15 is formed. Accordingly, the tubular body portion 10 having the front surface portion 18 and the rear surface portion 20 is formed.

Step (V 1):

The heat-sealed portion HS4 is formed by heat-sealing the lower ends 12*h* and 12*i* of the bottom member 12A and the lower end 10*c* side of the body portion 10 over the entire circumference of the body portion 10, thereby forming the bottom portion 12. As illustrated in FIG. 5A, in a stepped part of a region c where the side ends 12*d* and 12*e* of the bottom member 12A are positioned in the heat-sealed portion HS4, in order to enhance the effect of suppressing bonding failure, it is preferable to perform point sealing, which is stronger than the heat sealing for the heat-sealed portion HS4, in addition to the heat sealing for the heat-sealed portion HS4. Similarly, even in a stepped part of a region where the side ends 12*f* and 12*g* of the bottom member 12A are positioned in the heat-sealed portion HS4, in order to enhance the effect of suppressing bonding failure, it is preferable to perform point sealing in addition to the heat sealing for the heat-sealed portion HS4.

Step (VII):

In the upper portion of the body portion 10, the pouring pipe 24 of the spout 14 is inserted between the front surface portion 18 and the rear surface portion 20, and in a state where the pouring pipe 24 is interposed between the front surface portion 18 and the rear surface portion 20, as illustrated in FIG. 2, the heat-sealed portion HS5 is heat-sealed to liquid-tightly attach the spout 14 to the upper portion so as to be sealed.

As a method of filling the self-standing bag of the present invention with the contents, there are a method of filling from the pouring pipe 24, a method of filling before attaching the spout 14, a method of filling through a portion of the heat-scaled portion HS5 which is not heat-sealed but remains unsealed, and the like.

The contents are not particularly limited, and examples thereof include foods such as beverages, ice creams, and jellies, fluids such as cosmetics, shampoos, rinses, and soaps, powders, and solids.

In the method for manufacturing the self-standing bag of the present invention described above, the bottom member and the adhesive film are laminated so as to cause both the side ends of the adhesive film to respectively protrude from both the side ends of the bottom member in the width direction, and both the side ends of the bottom member are attached to the body portion by the adhesive film. Since the laminated film is a single sheet, the positional relationship between the bottom member and the adhesive film can be easily controlled. Therefore, even in a case of manufacturing a self-standing hag with a small size, bonding failure due to deviation in the position of the adhesive film can be easily suppressed, and a self-standing bag in which leakage of contents is suppressed can be stably manufactured. In addition, in the bottom portion, since the adhesive film is laminated on the entire bottom member, a self-standing bag having excellent pinhole resistance for the entire bottom portion can be manufactured. Furthermore, since the heat-sealed portion where the inner surfaces of the front surface portion and the rear surface portion are bonded to each other is not formed at the side edge of the body portion, the obtained self-standing bag does not cause discomfort when the body portion is grasped by hand, and has excellent outer appearance.

The method for manufacturing the self-standing bag of the present invention is not limited to the manufacturing method described above. For example, the step (VII) in the method for manufacturing the self-standing bag 1 may be performed after the step (V), and is not limited to a method in which the steps are performed in the above-described order. For example, a method in which the step (VII) is performed after the step (V) and the step (VI) is performed thereafter may also be adopted. Alternatively, a method in which the step (VII) is not performed may also be adopted.

In addition, in order to cause the lower ends 12*h* and 12*i* of the bottom member 12A and the lower ends 22*g* and 22*h* of the adhesive film 22 to be coincident with the lower end 10*c* in the body member 10A when the self-standing bag 1 is formed, it is preferable that a heat-sealed portion formed in the step (VI) be caused to be larger in width than the heat-sealed portion HS4 and the heat-sealed portion with a larger width be cut in the width direction of the body portion 10 to form the lower end of the self-standing bag.

INDUSTRIAL APPLICABILITY

According to the present invention, it is possible to provide a self-standing bag which gives no discomfort when a body portion is grasped by hand, can be easily manufactured even if the size is small, can stably suppress leakage of contents, and has excellent pinhole resistance at a bottom portion, and a method for manufacturing the same.

REFERENCE SIGNS LIST

1 self-standing bag
10 body portion
10A body member
12 bottom portion
12A bottom member
12*d* to 12*g* side end
18 front surface portion
20 rear surface portion
22 adhesive film
22*c* to 22*f* side end

The invention claimed is:

1. A self-standing bag, comprising:

a body portion formed of a body member in a tubular shape; and a bottom portion formed of a half-folded bottom member which is attached to an inside of the body portion with a first folding line of the bottom member on an upper side, wherein each of side ends of the bottom member is bonded to an inner surface of the body portion, a lower end of the bottom member is bonded on a lower end side of the body portion on an entire circumference of the body portion, on the body portion side of the bottom member, an adhesive film for bonding a side end of the bottom member to the body portion is laminated to cover the entire bottom member, both side ends of the adhesive film respectively protrude from both the side ends of the bottom member in a width direction, bonding of the side end of the bottom member to the inner surface of the body portion is achieved in a bonding portion by the adhesive film, the body portion has a flat shape having a front surface portion and a rear surface portion, a border between the front surface portion and the rear surface portion is formed of a second folding line crossing the width direction, and the bonding portion crosses a side end of the adhesive film and the side end of the bottom member, and the side end of the adhesive film is closed.

2. The self-standing bag according to claim 1, wherein a side end side of the bottom member and a side end side of the adhesive film, which laminate each other, are folded along the second folding line, the side end of the bottom member and the side end of the adhesive film are at positions closer to a center in the width direction of the body portion than the second folding line, and the bonding portion is a heat-sealed portion, and the heat-sealed portion crosses the side end of the adhesive film and the first folding line.

* * * * *